US011920261B2

(12) United States Patent
Ga et al.

(10) Patent No.: US 11,920,261 B2
(45) Date of Patent: Mar. 5, 2024

(54) CELLULOSE ACETATE FIBER, CELLULOSE ACETATE BAND, AND METHOD FOR MANUFACTURING CELLULOSE ACETATE BAND

(71) Applicant: DAICEL CORPORATION, Osaka (JP)

(72) Inventors: Kyokutou Ga, Tokyo (JP); Hiroki Taniguchi, Tokyo (JP)

(73) Assignee: DAICEL CORPORATION, Osaka (JP)

( * ) Notice: Subject to any disclaimer, the term of this patent is extended or adjusted under 35 U.S.C. 154(b) by 468 days.

(21) Appl. No.: 17/259,354

(22) PCT Filed: Aug. 14, 2018

(86) PCT No.: PCT/JP2018/030263

§ 371 (c)(1),
(2) Date: Jan. 11, 2021

(87) PCT Pub. No.: WO2020/035901

PCT Pub. Date: Feb. 20, 2020

(65) Prior Publication Data

US 2021/0180215 A1 Jun. 17, 2021

(51) Int. Cl.
*D01F 2/30* (2006.01)
*D01F 1/02* (2006.01)

(52) U.S. Cl.
CPC ..... *D01F 2/30* (2013.01); *D01F 1/02* (2013.01)

(58) Field of Classification Search
CPC ..... D01F 2/28; D01F 2/30; D01F 1/10; D01F 1/20

(Continued)

(56) References Cited

U.S. PATENT DOCUMENTS 3,618,619 A 11/1971 Kiefer
2013/0112214 A1* 5/2013 Bundren ..... D02G 1/14 977/734
2017/0006912 A1 1/2017 Shibagaki et al.

FOREIGN PATENT DOCUMENTS

JP 47-37203 B 9/1972
JP 8-500152 A 1/1996

(Continued)

OTHER PUBLICATIONS

Office Action dated Oct. 20, 2021, in Russian Patent Application No. 2021106200(013419).

(Continued)

*Primary Examiner* — Camie S Thompson
(74) *Attorney, Agent, or Firm* — Birch, Stewart, Kolasch & Birch, LLP

(57) ABSTRACT

An object is to mitigate plugging of spinneret hole, the plugging occurring with the passage of spinning time, even though cellulose acetate has a small titanium dioxide content or contains no titanium dioxide, and to prevent a reduction in pressure drop of the resulting cellulose acetate band. A cellulose acetate fiber having a titanium dioxide content of not greater than 0.05 wt. %; and a content of at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ of not smaller than 0.05 wt. % and not greater than 1 wt. %.

14 Claims, 2 Drawing Sheets

(58) Field of Classification Search
USPC ..... 428/393, 364
See application file for complete search history.

(56) References Cited

FOREIGN PATENT DOCUMENTS

| | | | |
|---|---|---|---|
| JP | 10-168650 | A | 6/1998 |
| JP | 10-317227 | A | 12/1998 |
| JP | 2004-68198 | A | 3/2004 |
| JP | 2015-503038 | A | 1/2015 |
| JP | 2015-508992 | A | 3/2015 |
| RU | 2 609 674 | C1 | 2/2017 |
| WO | WO 93/24685 | A1 | 12/1993 |
| WO | WO 2013/067503 | A1 | 5/2013 |
| WO | WO 2013/067511 | A2 | 5/2013 |

OTHER PUBLICATIONS

English translation of the International Preliminary Report on Patentability, dated Oct. 11, 2019, for International Application No. PCT/JP2018/030263.

Rustemeyer, "Cellulose Acetates: Properties and Applications," Mar. 2004 (Macramolecular Symposia, Heidelberg, Germany, Sep. 29-Oct. 1, 2003), pp. 266-281 (total 10 pages).

Shalaby et al., "Preparation and Application of Magnetite Nanoparticles Immobilized on Cellulose Acetate Nanofibers for Lead Removal from Polluted Water," Water Science & Technology: Water Supply, vol. 17, No. 1, 2017 (Available online Jul. 27, 2016), pp. 176-187.

Steinmeier, "Acetate Manufacturing, Process and Technology," Macromol. Symp., 2004, vol. 208, pp. 49-60 (total 7 pages).

Extended European Search Report for European Application No. 18930491.8, dated Dec. 13, 2022.

Korean Office Action for Korean Application No. 10-2020-7036099, dated Dec. 21, 2022, with an English translation.

* cited by examiner

CELLULOSE ACETATE FIBER, CELLULOSE ACETATE BAND, AND METHOD FOR MANUFACTURING CELLULOSE ACETATE BAND

TECHNICAL FIELD

The present invention relates to a cellulose acetate fiber, a cellulose acetate band, and a method for producing a cellulose acetate band.

BACKGROUND ART

A fiber formed from cellulose acetate, especially, from cellulose diacetate, is useful as a material for a cigarette filter used in a cigarette including an e-cigarette, and as a material for a sanitary article, etc. Cellulose acetate, when used in these applications, is used as a cellulose acetate band composed of a cellulose acetate fiber.

Typically, in dry-spinning cellulose acetate, a spinning dope (also referred to as a "dope") prepared by dissolving cellulose acetate in an organic solvent is extruded from a spinneret hole of a spinneret. The solvent in the spinning dope is then evaporated to spin (form a shape of) cellulose acetate. In spinning a cellulose acetate fiber, acetone is often used as the organic solvent included in the spinning dope (Non-Patent Literature 1).

As disclosed in Patent Document 1, in producing a cellulose acetate band (hereinafter, also referred to simply as a "band"), a yarn is formed of a plurality of cellulose acetate fibers. A plurality of yarns is combined to form a tow. The tow is crimped to produce a band. The band is packed in a packaging sleeve and compression-packed.

In addition, a sulfuric acid catalyst is used for cellulose acetate in acetylation of the cellulose acetate and is neutralized with calcium acetate or the like in hydrolysis of the cellulose acetate or the like. Furthermore, to prevent hydrolysis of cellulose acetate in drying, an alkaline earth metal is added (Non-Patent Literature 2).

The band is required to look good in appearance, thus titanium dioxide is added to a spinning dope of the related art to impart a matting effect to the band, and thereby making the appearance of the band white. Thus, titanium dioxide is typically included in the dope in the related art.

For example, Patent Document 2 describes: "provides cellulose ester fibers having an intermediate degree of substitution per anhydroglucose unit (DS/AGU) along with pigments which act as photooxidation catalysts. The fibers are useful as filter materials for tobacco products. The filter materials thus provided are easily dispersible and biodegradable and do not persist in the environment".

The object of Patent Document 2 is to increase biodegradability, and Patent Document 2 discloses adding an anatase titanium dioxide for this purpose. In addition, Patent Document 2 discloses examples of a metal useful for increasing the thermooxidation process, the metal allowed to coexist as a salt with the anatase titanium dioxide, including Cu, Fe, or Ni contained in a form of a salt, such as a nitrate, an acetate, a propionate, a benzoate, or a chloride; or Ca, Mg, Ba, or Zn preferably present as a sulfate or a phosphate; or sodium or potassium present as a sulfate.

CITATION LIST

Patent Document

Patent Document 1: JP 2004-068198 A
Patent Document 2: JP H08-500152 T

Non-Patent Literature

Non-Patent Literature 1: Cellulose Acetates: Properties and Applications. Pages 266-281, Issue edited by: P. Rustemeyer. March 2004.
Non-Patent Literature 2: Macromol. Symp. 2004, Cellulose Acetates: Properties and Applications. Pages 208, 49-60

SUMMARY OF INVENTION

Technical Problem

Improving the production rate of the tow or band means increasing the spinning rate. Thus, increasing the spinning rate while producing the tow or band composed of a fiber with the same single fiber diameter (filament denier) means increasing the rate at which the spinning dope (dope) passes through a spinneret hole (the extrusion rate [extrusion amount per unit time] of the dope). However, in attempting to increase the extrusion rate of the dope, the fluidity of the dope becomes unstable at the spinneret hole, presumably related to a problem with solution viscosity of the dope, leading to a problem of an increased frequency of spinning interruption, in particular, spinning interruption immediately below the spinneret (before drying).

The present inventors have found that the cause of this problem is due to titanium dioxide dispersed in the spinning dope (dope). The present inventors have also found that, when the titanium dioxide content is reduced to a certain amount, the frequency of spinning interruption does not increase even in performing high-speed spinning.

In addition, given a concern about the negative impact of titanium dioxide on health, reduction of the titanium dioxide content is effective in terms of potentially avoiding the use of titanium dioxide.

However, the present inventors have also found that the tow spun using a spinning dope (dope) with such a reduced titanium dioxide content has certain problems. The spinning dope is accumulated in corner and edge portions of the spinneret hole due to surface tension and further accumulated as a solid by drying. Thus, it has been found that the reduction in titanium dioxide content results in significant plugging of the spinneret hole as the duration of the spinneret usage becomes longer, which may be due to the loss of the abrasive effect by titanium dioxide or weakened effect of calcium adsorption by titanium dioxide in the spinning dope.

In addition, the cellulose acetate band obtained by extruding cellulose acetate from the spinneret hole thus plugged and then spinning the cellulose acetate will have a reduction in pressure drop with the passage of spinning time, and thus exhibits change in quality. In particular, in using the cellulose acetate band for cigarette filters or the like, the pressure drop of each cigarette filter will be uneven. This will lead to the necessity of replacing the spinneret periodically. The increased frequency of replacing the spinneret will also lead to reduced production efficiency and increased workload.

An object of the present invention is to mitigate plugging of the spinneret hole, the plugging occurring with the passage of spinning time, even though cellulose acetate has a small titanium dioxide content or contains no titanium dioxide, and to prevent a reduction in pressure drop of the resulting cellulose acetate band.

Solution to Problem

A first aspect of the present invention relates to a cellulose acetate fiber in which a titanium dioxide content is not greater than 0.05 wt. % and a content of at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ is not smaller than 0.05 wt. % and not greater than 1 wt. %.

The cellulose acetate fiber may have a calcium content of not greater than 100 ppm.

In the cellulose acetate fiber, the metal oxide may be $Fe_3O_4$ or $Fe_2O_3$.

The cellulose acetate fiber may have a feret area of not greater than 0.50.

The cellulose acetate fiber may have a filament denier of not less than 1.0 and not greater than 12.0.

A second aspect of the present disclosure relates to a cellulose acetate band composed of the cellulose acetate fiber.

The cellulose acetate band may have a total denier of not less than 8000 and not greater than 44000.

A third aspect of the present invention is a method for producing a cellulose acetate band, the method including: preparing a spinning dope including dissolving cellulose acetate, and adding at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ at not smaller than 0.05 wt. % and not greater than 1 wt. % in terms of solid content; filtering the spinning dope; and spinning the cellulose acetate using the filtered spinning dope; wherein titanium dioxide is not added until the spinning.

Advantageous Effects of Invention

An embodiment of the present invention can mitigate plugging of the spinneret hole, the plugging occurring with the passage of spinning time, even though cellulose acetate has a small titanium dioxide content or contains no titanium dioxide. And thus, a reduction in pressure drop of the resulting cellulose acetate band can be prevented.

DESCRIPTION OF EMBODIMENTS

Figure 1:
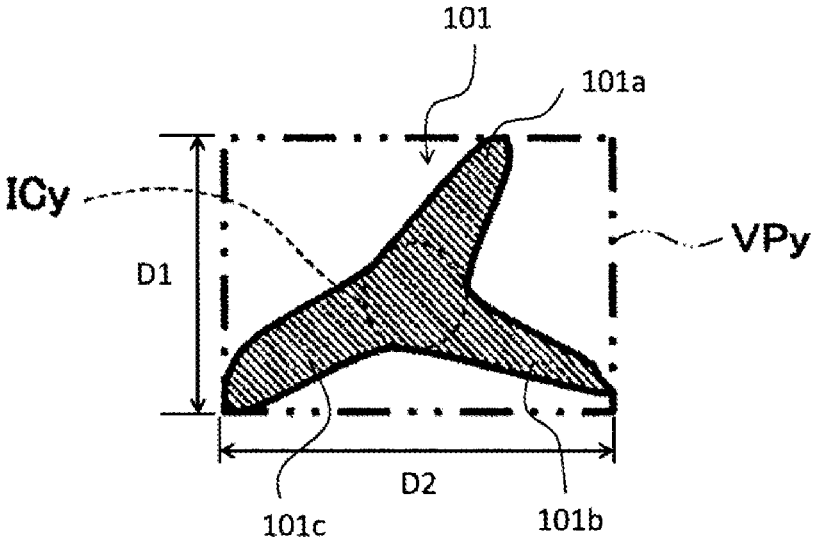
FIG. 1 is a diagram illustrating a method of deriving a feret area.

In the present specification, terms defined as described below are used.

TD: An abbreviation of a total denier referring to denier (the number of grams per 9000 m) of an assembly of tows (band).

FD: An abbreviation of filament denier, that is, a denier per filament, referring to denier (the number of grams per 9000 m) of a single fiber (one piece of filament). Also referred to as single fiber denier.

Filament: A continuous long fiber; particularly referring to a single fiber extruded from the spinneret hole described below.

Spinneret hole: An orifice of the spinneret described below that extrudes a filament.

Band: The tows, which are an assembly of filaments (single fiber) that are extruded from each of a plurality of cabinets, are combined with the TD for the tows set to a predetermined value. The combined tows whose TD is set to a predetermined value is crimped. The combined crimped tows (an assembly of filaments) are called a band. That is, the band has a TD and a crimp-index. The band is packed in a bale form.

Tow: An assembly of the plurality of filaments extruded from a spinneret hole. An end and a yarn are each an aspect of the tow.

End: An assembly of filaments having a predetermined total denier obtained by combining (bundling) a plurality of filaments extruded from a plurality of spinneret holes.

Yarn: A bundle of filaments spun from one cabinet. Thus, the yarn is an assembly of filaments before combining.

Cellulose Acetate Fiber

A cellulose acetate fiber of the present disclosure has a titanium dioxide content of not greater than 0.05 wt. %; and a content of at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ of not smaller than 0.05 wt. % and not greater than 1 wt. %.

Titanium Dioxide

In the cellulose acetate fiber of the present disclosure, a titanium dioxide content is not greater than 0.05 wt. %. The titanium dioxide content is preferably not greater than 0.03 wt. % and more preferably not greater than 0.01 wt. %. In addition, the titanium dioxide content is most preferably 0 wt. %. This is because spinning interruption, in particular, spinning interruption immediately below the spinneret (before drying), can be reduced. Note that the "0 wt. %" described above includes a case where titanium dioxide is not included and a case where only a trace amount of titanium dioxide not greater than the analytical limit is included.

The titanium dioxide content in the cellulose acetate fiber can be measured by atomic absorption spectrometry or the like. In addition, the titanium oxide content in the cellulose acetate fiber can be measured according to "Testing methods for man-made filament yarns" specified in JIS L 1013: 2010. As an apparatus used in the testing method stipulated in this JIS L 1013, an apparatus stipulated in JIS K 0050 can be used. The titanium dioxide content can be also measured by gravimetry besides the atomic absorption spectrometry and the JIS method described above.

Metal Oxide

In the cellulose acetate fiber of the present disclosure, a content of at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ is not smaller than 0.05 wt. % and not greater than 1 wt. %. The content of the metal oxide may be not smaller than 0.05 wt. % and not greater than 0.8 wt. % or may be not smaller than 0.05 wt. % and not greater than 0.5 wt. %.

The content of the metal oxide in the cellulose acetate fiber can be measured by inductively coupled plasma-atomic emission spectrometry, atomic absorption spectrometry, or the like.

The average particle size of the metal oxide is not particularly limited but may be not smaller than 1 nm and not greater than 1000 nm, not smaller than 100 nm and not greater than 600 nm, or not smaller than 200 nm and not greater than 400 nm. Even the average particle size exceeding 600 nm would not change the effect of preventing a reduction in pressure drop of the cellulose acetate band. In addition, when an average particle size is too small, it would fail to sufficiently prevent a reduction in pressure drop in the cellulose acetate band.

The average particle size of the metal oxide can be measured using dynamic light scattering. The specific measurement procedure is as follows. First, a sample is prepared by forming a cellulose acetate fiber at a concentration of 100 ppm into an acetone suspension using an ultrasonic vibrating device. Then, the average particle size can be measured by measuring the particle size volume distribution by laser diffraction ("Laser Diffraction/Scattering Particle Size Distribution Measuring Apparatus LA-960" available from Horiba Ltd., ultrasonic treatment for 15 minutes, and a refractive index (1.500, medium (water; 1.333)). The average particle size (such as in nm and μm) herein refers to the value of the particle size corresponding to 50% of the integrated scattering intensity in this particle size distribution.

The metal oxide is preferably $Fe_3O_4$ or $Fe_2O_3$. This is because of ease of handling and high safety. In particular, the high safety is suitable for using a cellulose acetate fiber or a cellulose acetate band as a material coming into touch with the human body, such as a cigarette filter. $Fe_3O_4$ or $Fe_2O_3$ is also preferred in terms of the low price.

Calcium Content and Magnesium Content

Calcium content in the cellulose acetate fiber of the present disclosure is not particularly limited, but the calcium content is preferably not greater than 100 ppm, more preferably not greater than 30 ppm, and even more preferably not greater than 10 ppm. This is because a reduction in pressure drop in cellulose acetate band can be further prevented. In addition, in terms of chemical stability of the cellulose acetate fiber, the calcium content may be not smaller than 1 ppm.

Magnesium content in the cellulose acetate fiber of the present disclosure is not particularly limited, but the magnesium content may be not smaller than 1 ppm, not smaller than 30 ppm, or not smaller than 100 ppm. In addition, in terms of stability of high-speed spinning, the magnesium content may be not greater than 300 ppm.

Calcium and magnesium included in the cellulose acetate fiber of the present disclosure may be derived from a neutralizing agent, a stabilizer, or wash water used in the production of cellulose acetate. Calcium and magnesium are present, for example, due to deposition on the cellulose acetate flake surface; or due to electrostatic interaction with a carboxyl group included in the cellulose fiber or a sulfate ester moiety formed during production.

As described below, in the production of cellulose acetate used as a raw material, when an acidic catalyst, such as sulfuric acid, is used as a catalyst, a calcium compound, such as calcium hydroxide; a magnesium compound, such as magnesium acetate; and the like may be added as a neutralizing agent or a stabilizer, or as a neutralizing agent and stabilizer to prevent modification of the cellulose acetate. The contents of calcium and magnesium in the cellulose acetate fiber can be adjusted according to the amounts of the calcium compound and magnesium compound added at this time.

The calcium content and the magnesium content in the cellulose acetate fiber each can be measured by atomic absorption spectrometry or the like.

Cross-Sectional Shape

The cross-sectional shape of the cellulose acetate fiber is not particularly limited and may be any of following shapes; a circle, an ellipse, a polygon, a hollow shape, and a heteromorphic shape, such as a Y shape, but is preferably a Y shape. The cellulose acetate fiber with a Y-shaped cross section is highly effective in blocking an airflow and exhibits pressure drop very well, thus providing suitable pressure drop of the cellulose acetate band.

The Y shape will be described with reference to FIG. 1, which illustrates an example of a Y-shaped cross section of a cellulose acetate fiber. In a cellulose acetate fiber 101 with a Y-shaped cross section, regions of the cross section excluding an inscribed circle (ICy) protrude outward from a plurality of portions (three portions) on the circumference of the inscribed circle ICy, and the plurality of portions is separated from each other in the circumferential direction. The plurality of portions is, for example, protrusions 101*a*, 101*b*, and 101*c*.

The cross-sectional shape of the fiber can be observed using an optical microscope, for example, as follows. A pencil-like filament sample is produced from the band. That is, fiber bundles are partially sampled from the band, and the fiber bundles are wrapped with paraffin to place the fiber bundles at a position corresponding to that of the lead in a pencil. The filament sample thus produced is sliced with a microtome into a thickness of 1 μm to 10 μm to form a sample slice, and the sample slice can be observed with an optical microscope ("BX-51", available from Olympus Corporation).

To produce the fiber by spinning cellulose acetate, the spinning dope is extruded from a plurality of spinneret holes in a spinneret in which a plurality of spinneret holes is formed as described below, and the cross-sectional shape of the fiber depends on the shape of the spinneret hole. To form the cellulose acetate fiber with the Y-shaped cross section, the shape of the spinneret hole needs to be triangular.

Feret Area

The feret area of the cellulose acetate fiber is not particularly limited but is preferably not greater than 0.5.

When the cross-sectional shape of the cellulose acetate fiber is Y-shaped, the Y-shaped cross section results from the contraction of the triangular shape of the spinneret hole, and thus the feret area is less than 0.5. The feret area is preferably not greater than 0.48, more preferably not greater than 0.43, and particularly preferably not greater than 0.42. The feret area greater than 0.5 would cause difficulty in achieving pressure drop. The lower limit is not particularly limited but is not less than 0.35. To make the feret area less than 0.35, the shape of the spinneret would be complicated, and this would readily cause plugging or interruption at the spinneret.

"Feret area" is an index that can be utilized to assess the heteromorphism of the fiber cross section. The feret area will be described with reference to FIG. 1, which illustrates an example of a Y-shaped cross section of a cellulose acetate fiber. In deriving the feret area, the fiber is cut at any point perpendicularly to the fiber long axis direction and its cross section can be realized. And then, a virtual parallelogram (VPy) that circumscribes this cross section is conceived. In this virtual parallelogram, one of the two pairs of facing sides is two parallel lines circumscribing the cross section and having an inter-line distance (D2) that is a maximum value (what is called a "maximum feret diameter"), and another pair is two parallel lines circumscribing the cross-section and having an inter-line distance (D1) that is a minimum value (what is called a "minimum feret diameter"). The feret area is an area ratio determined by dividing the cross-sectional area S of the fiber by the area (D1×D2) of the virtual parallelogram, in other words, the occupancy rate of the fiber cross section in the virtual parallelogram.

The configuration of the virtual parallelogram VPy circumscribing the cross section of the fiber, the cross-sectional area S of the fiber, and the area (D1×D2) of the virtual parallelogram can be measured by processing electronic data of an image captured through a microscope using a well-known image processing technique or by manual calculation based on the captured image.

Filament Denier

The filament denier (FD) of the cellulose acetate fiber of the present disclosure is preferably not less than 1.0 and not greater than 12.0, more preferably not less than 1.5 and not greater than 10.0, and even more preferably not less than 2.0 and not greater than 5.0. A production method of the present disclosure can mitigate plugging of the spinneret hole, the plugging occurring with the passage of spinning time, and thus is suitable for producing a thin cellulose acetate fiber as described herein.

The filament denier depends on the diameter of the spinneret hole. To adjust the filament denier to approximately not less than 1.0 and not greater than 12.0, the diameter of the spinneret hole may be approximately not less than 40 μm and not greater than 100 μm.

Total Degree of Acetyl Substitution

The total degree of acetyl substitution of the cellulose acetate fiber according to the present disclosure is preferably not less than 2.41 and not greater than 2.49, more preferably not less than 2.43 and not greater than 2.47, and even more preferably not less than 2.44 and not greater than 2.46. This is because the smaller variation in the degree of substitution can stabilize the extrusion from the spinneret hole.

The total degree of acetyl substitution can be measured by the following method. First, the total degree of acetyl substitution is the sum of each degree of substitution at position 2, 3, and 6 of the glucose ring of the cellulose acetate, and each degree of acetyl substitution at position 2, 3 and 6 of the glucose ring of the cellulose acetate can be measured by NMR according to the method of Tezuka (Tezuka, Carbonydr. Res. 273, 83 (1995)). That is, a free hydroxyl group of a cellulose diacetate sample is propionylated with propionic anhydride in pyridine. The resulting sample is dissolved in deuteriochloroform, and the $^{13}$C-NMR spectrum is measured. The carbon signals of the acetyl group appear in the region from 169 ppm to 171 ppm in the order of position 2, 3 and 6 from the high magnetic field; and the carbonyl carbon signals of the propionyl group appear in the region from 172 ppm to 174 ppm in the same order. Each degree of acetyl substitution at position 2, 3 and 6 of the glucose ring in the original cellulose diacetate can be determined from the presence ratio of the acetyl group and the propionyl group at the respective corresponding positions. The degree of acetyl substitution can be analyzed by $^{1}$H-NMR in addition to $^{13}$C-NMR.

Furthermore, the total degree of acetyl substitution is determined by converting the combined acetic acid determined according to the method for measuring the combined acetic acid in ASTM: D-817-91 (Testing methods for cellulose acetate, etc.). This is the most common procedure to determine the degree of substitution of cellulose acetate.

$$DS=162.14\times AV\times 0.01/(60.052-42.037\times AV\times 0.01)$$

In the above equation, DS is the total degree of acetyl substitution, and AV is the combined acetic acid (%). Note that the value of the degree of substitution obtained by the conversion usually has a slight discrepancy from the value measured by NMR described above. When the converted value and the value measured by NMR are different, the value measured by NMR is adopted. In addition, if the value varies among the specific methods of NMR measurement, the value measured by NMR according to the method of Tezuka described above is adopted.

The method for measuring the combined acetic acid according to ASTM: D-817-91 (Testing methods for cellulose acetate, etc.) is outlined as follows. First, 1.9 g of dried cellulose acetate is accurately weighed and dissolved in 150 mL of a mixed solution of acetone and dimethyl sulfoxide (a volume ratio of 4:1), then 30 mL of a 1 N sodium hydroxide solution is added, and the cellulose acetate is saponified at 25° C. for 2 hours. Phenolphthalein is added as an indicator, and the excess sodium hydroxide is titrated with 1N-sulfuric acid (concentration factor: F). In addition, a blank test is performed in the same manner as described above, and the combined acetic acid is calculated according to the following equation.

$$\text{Combined acetic acid (\%)}=\{6.5\times(B-A)\times F\}/W$$

where A represents the titration volume (mL) of the 1 N sulfuric acid for the sample, B represents the titration volume (mL) of the 1 N sulfuric acid for the blank test, F represents the concentration factor of the 1 N sulfuric acid, and W represents the weight of the sample.

Cellulose Acetate Band

A cellulose acetate band may be composed of the cellulose acetate fiber of the present disclosure.

The total denier (TD) of the cellulose acetate band is preferably not less than 8000 and not greater than 44000, more preferably not less than 15000 and not greater than 40000, and even more preferably not less than 25000 and not greater than 35000. This is because stable crimping can be applied to the tow and the nonuniformity in exhibiting pressure drop can be reduced.

Method for Producing Cellulose Acetate Band

A method for producing a cellulose acetate band of the present disclosure will be described in detail. The method for producing a cellulose acetate band of the present disclosure includes: preparing a spinning dope including dissolving cellulose acetate, and adding at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ at not smaller than 0.05 wt. % and not greater than 1 wt. % in terms of solid content; filtering the spinning dope; and spinning the cellulose acetate using the filtered spinning dope; in which titanium dioxide is not added until the spinning.

Preparation of Spinning Dope

The preparation of the spinning dope will be described. The preparation includes dissolving cellulose acetate, and adding at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ at not smaller than 0.05 wt. % and not greater than 1 wt. % in terms of solid content.

The addition of the metal oxide can mitigate plugging of the spinneret hole, the plugging occurring with the passage of spinning time, and can prevent a reduction in pressure drop of the resulting cellulose acetate band. In addition, the addition of the metal oxide can extend the use life of the spinneret.

One of the causes of the plugging of the spinneret hole is considered to be as follows: the spinning dope of cellulose acetate contains a component in which a hemicellulose moiety, such as glucuronoxylan derived from a raw material cellulose, is acetylated. This component forms a calcium salt, which appears as sediment or foreign matter.

However, the addition of the metal oxide to the spinning dope allows the metal oxide to adsorb calcium ions, thereby preventing the formation of the sediment or foreign matter. In addition, the metal oxide can also rub off the formed sediment or foreign matter.

The spinning dope is prepared by dissolving cellulose acetate used as a raw material in a solvent that can dissolve the cellulose acetate, and adding at least one type of metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ at not smaller than 0.05 wt. % and not greater than 1 wt. % in terms of solid content. Examples of such a solvent include organic solvents, such as acetone and dichloromethane.

The concentration of cellulose acetate in the spinning dope needs to be adjusted to, for example, not smaller than 20 wt. % and not greater than 30 wt. %.

The concentration of the metal oxide in the spinning dope needs to be not smaller than 0.05 wt. % and not greater than 1 wt. % in terms of solid content by adjusting the amount of each component contained in the spinning dope. The concentration of the metal oxide may be not smaller than 0.05 wt. % and not greater than 0.8 wt. %, or not smaller than 0.05 wt. % and not greater than 0.5 wt. %.

An excess content of the metal oxide would not affect the effect of preventing a reduction in pressure drop of the cellulose acetate band but may increase spinning interruption, in particular, spinning interruption immediately below the spinneret (before drying). In addition, when a content of the metal oxide is too small, it would fail to sufficiently prevent a reduction in pressure drop in the cellulose acetate band.

The temperature of the spinning dope needs to be adjusted to, for example, not lower than 45° C. and not higher than 55° C.

In the preparation of the spinning dope, titanium dioxide is preferably not added, in other words, titanium dioxide is preferably not included, but a trace amount of titanium dioxide can be included in the spinning dope so that the content in the cellulose acetate band is not greater than approximately 0.05 wt. % or not greater than approximately 0.03 wt. %.

In addition, cellulose acetate used as a raw material can be produced as follows. So-called an acetic acid method can be used, in which acetic anhydride is used as an acetylation agent, acetic acid as a diluent, and sulfuric acid as a catalyst. In pretreatments, a cellulose material, such as pulp or linter, is ground, and acetic acid containing or not containing a sulfuric acid catalyst is added. Then, acetic acid, acetic anhydride, and a sulfuric acid catalyst that have been cooled are added to perform acetylation with a kneader while the temperature is controlled with an external jacket (acetylation). Fully trisubstituted cellulose acetate (primary cellulose acetate) is produced by acetylation, then the viscous, fully trisubstituted cellulose acetate is charged into a hydrolysis vessel, a neutralizing agent, such as a magnesium acetate solution, is added to neutralize (fully neutralize or partially neutralize) sulfuric acid with magnesium or the like and to inactivate acetic anhydride with moisture included in the magnesium acetate solution or the like and to perform hydrolysis, and cellulose acetate with a desired degree of acetylation is produced (aging). A large amount of water is added to this cellulose acetate (secondary cellulose acetate) to precipitate cellulose acetate (precipitation). The precipitated cellulose acetate is separated by solid-liquid separation and washed (purification), and dried to obtain cellulose acetate (drying). In washing with water in washing the precipitated cellulose acetate, an alkali metal compound and/or an alkaline earth metal compound, in particular, a magnesium acetate solution and a calcium compound, such as calcium hydroxide, may be added as a stabilizer.

The contents of calcium and magnesium in the cellulose acetate fiber and cellulose acetate band can be adjusted according to the amounts of the calcium compound and magnesium compound added at this time.

In the production of cellulose acetate used as a raw material, magnesium acetate is preferably used as a stabilizer. This is because use of calcium hydroxide would readily increase the calcium contents in the cellulose acetate fiber and cellulose acetate band, causing difficulty in preventing the reduction in pressure drop.

Filtration

Filtration of the spinning dope will be described. To remove foreign matter in the spinning dope, the method of filtration is not particularly limited. Examples of the method of filtration include filter filtration.

Examples of a filter medium for the filter filtration include filter media made of cellulose, synthetic fiber, and a metal material, such as stainless steel, as the main material.

In addition, the filter filtration preferably includes a plurality of filtrations. This is because a filtration performed in a single filtration would significantly shorten the life of the filter media and would readily reduce productivity. In including a plurality of filtrations, a multi-stage filtration method is preferably employed.

Spinning

The spinning of cellulose acetate using the spinning dope will be described. The spinning dope is extruded from a plurality of spinneret holes in a spinneret in which a plurality of spinneret holes is formed. The organic solvent in the extruded spinning dope is evaporated with hot air to dry the cellulose acetate. Then, the cellulose acetate is wound with a roll to obtain the cellulose acetate band.

For example, to adjust the filament denier of the cellulose acetate fiber to not less than 1.0 and not greater than 12.0, the diameter of the spinneret hole needs to be set to not less than 40 μm and not greater than 100 μm, and the extrusion rate in extruding the spinning dope from the spinneret hole needs to be set to a range of not smaller than 500 m/min and not greater than 900 m/min.

In addition, to adjust the total denier of the cellulose acetate band to not less than 8000 and not greater than 44000, for example, the diameter of the spinneret hole needs to be set to not less than 40 μm and not greater than 100 μm, and the number of spinneret holes needs to be set to a range of not less than 100 and not greater than 1000.

Titanium Dioxide

In the method for producing a cellulose acetate band of the present disclosure, titanium dioxide is not added until the spinning, and thus titanium dioxide is not included, or, if included, the titanium dioxide content can be greatly reduced. Thus, the frequency of spinning interruption does not increase even in the case of performing high-speed spinning. Furthermore, in extruding the spinning dope (dope) containing titanium dioxide from the spinneret hole, increasing the extrusion rate in extruding the spinning dope (dope) from the spinneret hole may problematically destabilize the fluidity of the dope in the spinneret hole, probably due to a problem of solution viscosity of the spinning dope (dope). However, the present disclosure can solve this problem.

Production Apparatus for Cellulose Acetate Band

Figure 2:
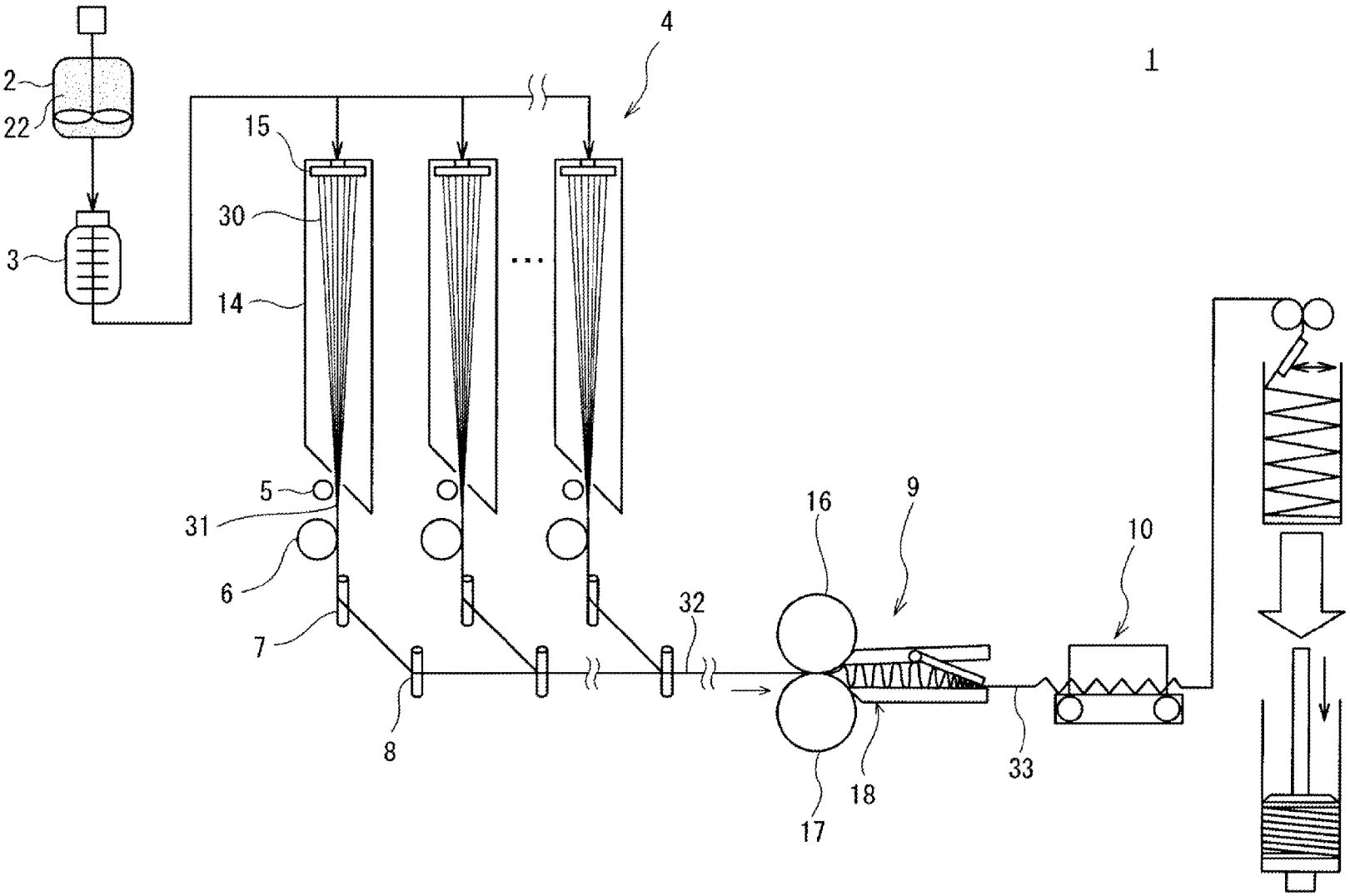
FIG. 2 is a conceptual diagram illustrating an apparatus and method for producing a cellulose acetate band.

FIG. 2 is a general view of a production apparatus 1 for cellulose acetate band (hereinafter, also referred to as "the production apparatus 1"). The production apparatus 1 produces a band 33 by a dry spinning method.

In the production apparatus 1, a spinning dope 22 in which cellulose acetate flakes used as a raw material are dissolved in an organic solvent is used. This spinning dope 22 is mixed in a mixing apparatus 2 and then filtered in a filtration apparatus 3. The spinning dope 22 that has passed through the filtration apparatus 3 is extruded from a plurality of spinneret holes of a spinneret 15 provided on a cabinet 14 of a spinning unit 4. The cabinet 14 may be cylindrical. The spinning dope 22 extruded from each spinneret hole is dried by evaporating the organic solvent with hot air supplied into the cabinet 14 from a drying unit (not illustrated). Solid filaments 30 are thus formed.

The filaments 30 are guided with guide pins 7 and 8, which are guiding devices (also referred to as a "guiding"). In these guiding devices, a width of a line of a plurality of the filaments 30 is adjusted by a width-adjusting guide. The plurality of the filaments 30 that has passed through one cabinet 14 are gathered by the width-adjusting guide and formed into a yarn 31. The yarn 31 may be subjected to application of a lubricant (herein, a lubricant emulsion) by a lubrication unit 5 (as an example, a rotating roll) while the yarn 31 is being guided by the guide pins 7 and 8.

The width of a line of the yarn 31 is then adjusted and further narrowed by the guide pins 7 and 8. Thereafter, the yarn 31 is wound with a godet roll 6. The yarn 31 travels around the roll surface of the godet roll 6 only for about ¾ of the surface and then is taken up by a predetermined winding apparatus. A series of units for producing the yarn 31, that is, the spinning unit 4 extruding the spinning dope 22 from the spinneret 15 to spin the filaments 30, the drying unit, the lubrication unit 5, and a winding unit having the godet roll 6, is collectively referred to as a "station". Typically, a plurality of stations is arranged in a line.

The yarn 31 is taken up from the roll surface of the godet roll 6 in a horizontal direction by the winding apparatus. The guide pins 7 and 8 change the direction of guiding the yarn 31, which passed through each and every station, by 90°. Each yarn 31 is transported along the arrangement direction of the stations and sequentially accumulated or layered. A plurality of the yarns 31 is thus bundled to form an end (a tow) 32, which is a flat assembly of the yarns 31. The end 32 is formed by bundling a plurality of the yarns 31 and finally setting a total denier to a predetermined total denier. The end 32 is transported in a horizontal state and guided to a crimping apparatus 9.

The crimping apparatus 9 has a pair of nip rolls 16 and 17 for pushing the end 32 into a stuffing box (crimping box) 18. As the pair of the nip rolls 16 and 17 push the end 32 into the stuffing box 18, the end 32 receives resistance from inside of the stuffing box 18. However, the pair of the nip rolls 16 and 17 pushes the end 32 into the stuffing box 18 with a force larger than this resistance, imparting crimping to the end 32. A band 33 is thus produced. The band 33 that has passed through the crimping apparatus 9 is dried with a drying apparatus 10. The band 33 that passed through the drying apparatus 10 is accumulated and then subjected to compression packing to produce a bale.

EXAMPLES

Hereinafter, the present invention will be specifically described with reference to examples, but the technical scope of the present invention is not limited by these examples.

Each physical property of Examples, Comparative Example, and Reference Example described below were evaluated according to the following methods.

Titanium Dioxide Content in Cellulose Acetate Band

The titanium dioxide content in a cellulose acetate band was measured as follows.

a) The absolute dry weight of about 5 g of a sample was determined, and the sample was incinerated to ash in an electric furnace, while avoiding intense heat. The ash was transferred into a 200-mL beaker with a small amount of water, and then the moisture was removed by heating the beaker. Thereafter, 15 mL of concentrated sulfuric acid, a guaranteed reagent specified in JIS K 8951 (specific gravity of 1.84), and about 10 g of ammonium sulfate, a guaranteed reagent specified in JIS K 8960, were added, and the mixture was covered with a watch glass. The mixture was heated on a sand bath gradually at the beginning and intensely at the end until the liquid turned transparent.

b) The liquid was allowed to cool, then water was carefully added to make the total amount approximately 100 mL while the liquid temperature was controlled not to rise to 50° C. or higher. The mixture was transferred to a 1-L volumetric flask and diluted with water up to the graduation marking. From this liquid, A mL (an amount which gives absorbance of a color reagent to be from 0.3 to 0.5, depending on the content of titanium dioxide and the thickness of a cell) of the liquid was transferred to a 50 mL volumetric flask using a pipet. Then, 5 mL of hydrogen peroxide (3 w/v %, guaranteed reagent) stipulated in JIS K 8230 and 10 mL of 1 mol/L sulfuric acid (guaranteed reagent) stipulated in JIS K 8951 were added to the liquid in the volumetric flask to develop a color. Thereafter, the liquid was diluted with water up to the graduated marking.

c) This liquid in the volumetric flask was transferred to a cell, and the absorbance at a wavelength of 420 nm was measured with a photoelectric colorimeter. Using a calibration curve produced in advance, the titanium dioxide concentration (g/50 mL) was determined based on the measurement. The percentage of the titanium dioxide was then calculated by the following Equation. An average value of two measurements was rounded to two decimal places by Rule B specified in JIS Z 8401 (rounding method).

$$\mathrm{Tl(wt.\ \%)}=((B\times 1000)/(C\times A))\times 100$$

where Tl is titanium dioxide (wt. %), A is the diluted liquid collected (mL), B is the titanium dioxide concentration (g/50 mL), and C is the absolute dry weight (g) of the sample.

Content of $Fe_2O_3$ in Cellulose Acetate Band

The content of $Fe_2O_3$ in the cellulose acetate band was measured as follows.

About 0.1 g of the sample was taken, precisely weighed into a platinum crucible, and incinerated to ash on an electric heater. Then, the sample was further heated in an electric furnace under conditions of 500° C. for 1 hour and subsequently 600° C. for 1 hour to complete the incineration. The platinum crucible was allowed to cool, then a small amount of ultrapure water and 0.12 mL of concentrated hydrochloric acid were added to the platinum crucible, and the ash was heat-dissolved on a sand bath. Then, the solution was made to 20 mL with ultrapure water and subjected to ICP-AES analysis to obtain the measurement result. A standard solution for the calibration curve was prepared by appropriately diluting a standard solution for atomic absorption spectrometry Fe 1000 with an aqueous nitric acid solution at the same concentration as that of the sample and used. ICP-AES is inductively coupled plasma-atomic emission spectrometry. In addition, an instrument used for ICP-AES analysis was CIROS-120 available from Rigaku Corporation.

The same operation was performed on an empty platinum crucible containing no sample, and the empty platinum crucible was subjected to ICP-AES analysis to obtain a blank test value. The blank test value was subtracted from the measurement result to determine the metal concentration (iron concentration) in the sample, and the metal concentration (iron concentration) was converted to the concentration (wt. %) of the metal oxide ($Fe_2O_3$).

Calcium Content and Magnesium Content in Cellulose Acetate Band

Into a crucible, 3.0 g of an undried sample was weighed and carbonized on an electric heater, and then incinerated to ash in an electric furnace at not lower than 750° C. and 850° C. for approximately 2 hours. The sample was allowed to cool for about 30 minutes, then 25 mL of a 0.07 wt. % hydrochloric acid solution was added, and the sample was heat-dissolved at not lower than 220° C. and not higher than 230° C. The solution was allowed to cool, then made to 200 mL with distilled water, and this solution was used as a test liquid. The test liquid and a standard liquid were measured for absorbance using an atomic absorption spectrophotometer to determine the calcium (Ca) content or the magnesium (Mg) content in the test liquid. These values were converted by the following equation, and the calcium (Ca) content or the magnesium (Mg) content in the sample were determined. The moisture in the sample can be measured using, for example, a Kett moisture meter (METTLER TOLEDO HB43). About 2.0 g of a sample in a water-containing state is placed on an aluminum sample pan of the Kett moisture meter and heated at 120° C. until the weight does not change, and the moisture (wt. %) in the sample can be calculated from the weight change before and after heating.

$$\text{Content of Ca or Mg in sample } (ppm) = \frac{\text{content of Ca or Mg in test liquid } (ppm) \times 200}{\text{sample weight (g)} \times (1 - \text{moisture } (wt.\ \%)/100} \quad \text{[Equation 1]}$$

Pressure Drop: Evaluation of Pressure Drop (PD)

A band was cut to a predetermined length and formed into a plug. The length (mm), circumference (mm), and net tow weight (NTW: g/rod) of the plug were determined in advance, and pressure drop (PD, mmWG) was measured at an air flow rate of 17.5 ml/sec using an automatic pressure drop meter ("QTM-6", available from CERULEAN, UK). This measurement result is a measured value of the pressure drop.

In addition, to evaluate a change in a pressure drop due to the time of use of the spinneret, that is, a change in pressure drop which occurs as the passage of spinning time, the rate of change (%) of the pressure drop in the average number of days of use of the spinneret (days) and the rate of change of the pressure drop per day (%/day) were determined by the following method.

Rate of change (%) of pressure drop in average number of days of use of spinneret={measured value (mmWG) of pressure drop−corrected value (mmWG) of pressure drop}/corrected value (mmWG) of pressure drop×100

Corrected value (mmWG) of pressure drop: Measured value of pressure drop×(1+0.003×((FD (day 0)−FD (relevant day))/0.01+(crimp-index (day 0)−crimp-index (relevant day)))

Crimp-index: measured according to a measurement method described in JP H07-316975 A by capturing an image of a surface of a band illuminated with light by imaging means and processing the captured image with a computer.

In addition, the average number of days of use of the spinneret (days) is the average value of the number of days of using one or two or more spinnerets when the cellulose acetate bands are continuously produced. When one or some spinnerets were replaced with a new spinneret or spinnerets during the production of cellulose acetate bands, the average number of days of use (days) was calculated by counting the day of the replacement as day 0.

The rate of change of the pressure drop per day (%/day) is a slope of a regression line with an intercept of 0 by the least squares method, plotting the average number of days of use of the spinneret (days) as the horizontal axis and the rate of change in pressure drop (%) as the vertical axis.

Example 1

A spinning dope was prepared by dissolving 29.0 parts by weight of cellulose acetate (total degree of acetyl substitution: 2.45) and 0.15 parts by weight of $Fe_2O_3$ (average particle size: 300 nm) in 68.5 parts by weight of acetone and 2.5 parts by weight of water. Titanium dioxide was not added, and thus the content of the titanium dioxide in the spinning dope was 0 wt. %.

In addition, 16 cabinets having a spinneret in which 650 spinneret holes each having a triangular orifice with a side length of 56 μm were formed were prepared. The spinning dope was heated to 50° C. and filtered with a filtration apparatus, then extruded from the spinneret hole of the spinneret, and cellulose acetate was spun. The spinning rate (winding rate of a pair of nip rolls) at this time was set to 600 m/min.

The spinning dope was extruded, and from the formed single fiber (filament), an end was produced. The ends were crimped with a crimping apparatus, and a cellulose acetate band was obtained. The filament denier (FD) of the cellulose acetate fiber was set to 2.9, and the total denier (TD) was set to 30000. In addition, the crimp-index of the cellulose acetate band was set to 30 per inch. The evaluation results of the resulting cellulose acetate band are shown in Table 1.

Example 2

In the same manner as in Example 1 with the exception that apparatuses after performing the filtration of the spinning dope containing titanium dioxide and the spinning of cellulose acetate were used to perform the filtration of the spinning dope and the spinning of cellulose acetate, a spinning dope was prepared and a cellulose acetate band was obtained.

The evaluation results of the resulting cellulose acetate band are shown in Table 1.

Example 3

In the same manner as in Example 1 with the exception that 0.015 parts by weight of $Fe_2O_3$ was added, and apparatuses after performing the filtration of the spinning dope containing titanium dioxide and the spinning of cellulose acetate were used to perform the filtration of the spinning dope and the spinning of cellulose acetate, a spinning dope was prepared and a cellulose acetate band was obtained.

The evaluation results of the resulting cellulose acetate band are shown in Table 1.

Comparative Example 1

A cellulose acetate band was produced in the same manner as in Example 1 with the exception that the spinning dope was prepared without adding $Fe_2O_3$. The evaluation results of the resulting cellulose acetate band are shown in Table 1.

Reference Example 1

A cellulose acetate band was produced in the same manner as in Comparative Example 1 with the exception that 0.15 parts by weight of titanium dioxide was added to the spinning dope. The evaluation results of the resulting cellulose acetate band are shown in Table 1.

TABLE 1

| | Cellulose acetate band | | | | | | | Evaluation of pressure drop | | | | |
|---|---|---|---|---|---|---|---|---|---|---|---|---|
| | | | | $Fe_2O_3$ | | | | Plug conditions | | | Rate of change of | Change in |
| | FD | TD | $TiO_2$ Content (wt. %) | Content (wt. %) | Average particle size (nm) | Ca amount (ppm) | Mg amount (ppm) | Length (mm) | Circum-ference (mm) | NTW (g/rod) | pressure drop (%/day) | pressure drop over time |
| Example 1 | 2.9 | 30200 | 0 | 0.5 | 300 | 60 | 5 | 108 | 24.55 | 0.525 | −0.35 | Average number of days of use of spinneret<br>PD (mmWG) (measured value)<br>PD (mmWG) (corrected value)<br>Rate of change (%) of PD |
| Example 2 | 2.9 | 29900 | 0.03 | 0.5 | 300 | 60 | 5 | 108 | 24.55 | 0.525 | −0.33 | Average number of days of use of spinneret<br>PD (mmWG) (measured value)<br>PD (mmWG) (corrected value)<br>Rate of change (%) of PD |
| Example 3 | 2.9 | 30100 | 0.03 | 0.05 | 300 | 60 | 5 | 108 | 24.55 | 0.525 | −0.60 | Average number of days of use of spinneret<br>PD (mmWG) (measured value)<br>PD (mmWG) (corrected value)<br>Rate of change (%) of PD |
| Comparative Example 1 | 2.9 | 30000 | 0 | 0 | — | 60 | 5 | 108 | 24 | 0.5 | −0.80 | Average number of days of use of spinneret<br>PD (mmWG) (measured value)<br>PD (mmWG) (corrected value)<br>Rate of change (%) of PD |
| Reference Example 1 | 2.9 | 30000 | 0.5 | 0 | — | 60 | 5 | 108 | 24 | 0.5 | −0.31 | Average number of days of use of spinneret<br>PD (mmWG) (measured value)<br>PD (mmWG) (corrected value)<br>Rate of change (%) of PD |

TABLE 1-continued

| | Evaluation of pressure drop<br>Change in pressure drop over time | | | | | | | | | |
|---|---|---|---|---|---|---|---|---|---|---|
| Example 1 | 0.0 | 2.0 | 6.0 | 10.0 | 15.0 | 18.5 | 20.0 | | | |
| | 271 | 272 | 274 | 272 | 267 | 268 | 270 | | | |
| | 271 | 278 | 284 | 285 | 282 | 286 | 289 | | | |
| | 0.0 | −2.0 | −3.6 | −4.5 | −5.2 | −6.2 | −6.5 | | | |
| Example 2 | 0.0 | 3.0 | 8.0 | 10.0 | 15.0 | 16.0 | 17.0 | 21.4 | | |
| | 273 | 272 | 264 | 270 | 268 | 265 | 267 | 265 | | |
| | 273 | 278 | 274 | 282 | 281 | 280 | 283 | 282 | | |
| | 0.0 | −2.0 | −3.5 | −4.3 | −4.6 | −5.4 | −5.7 | −6.0 | | |
| Example 3 | 0.0 | 3.0 | 8.0 | 10.0 | 15.0 | | | | | |
| | 275 | 272 | 266 | 270 | 273 | | | | | |
| | 275 | 281 | 284 | 289 | 296 | | | | | |
| | 0.0 | −3.0 | −6.3 | −6.5 | −7.6 | | | | | |
| Comparative | 0.0 | 1.0 | 2.0 | 3.9 | 4.9 | 6.9 | 7.0 | 7.4 | 8.5 | 13.2 |
| Example 1 | 331 | 322 | 322 | 302 | 310 | 307 | 302 | 324 | 322 | 319 |
| | 331 | 330 | 330 | 317 | 326 | 325 | 327 | 345 | 346 | 347 |
| | 0.0 | −2.4 | −2.4 | −4.7 | −4.9 | −5.5 | −7.6 | −6.1 | −6.9 | −8.1 |
| Reference | 0.0 | 6.0 | 12.0 | 17.0 | 19.0 | | | | | |
| Example 1 | 280 | 276 | 274 | 275 | 270 | | | | | |
| | 280 | 286 | 286 | 288 | 286 | | | | | |
| | 0.0 | −3.5 | −4.2 | −4.5 | −5.8 | | | | | |

As shown in Table 1, the band of Comparative Example had a titanium dioxide content of 0 wt. % and thus had a very large rate of change (%/day) of the pressure drop. In contrast, the production method of Examples, despite the titanium dioxide content of 0 wt. % or the trace amount of 0.03 wt. %, achieves a small rate of change (%/day) of the pressure drop over the spinning time, the rate of change equivalent to that of a band having a titanium dioxide content of greater than 0.05 wt. % (Reference Example 1) and can prevent the reduction in pressure drop of the cellulose acetate band.

The invention claimed is:

1. A cellulose acetate fiber having:

a titanium dioxide content of not greater than 0.05 wt. %;

a content of at least one metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ of not smaller than 0.05 wt. % and not greater than 1 wt. %; and wherein the magnesium content is not greater than 300 ppm.

2. The cellulose acetate fiber according to claim 1, wherein calcium content is not greater than 100 ppm.

3. The cellulose acetate fiber according to claim 1, wherein the metal oxide is $Fe_3O_4$ or $Fe_2O_3$.

4. The cellulose acetate fiber according to claim 1, wherein a feret area is not greater than 0.50.

5. The cellulose acetate fiber according to claim 1, wherein a filament denier is not less than 1.0 and not greater than 12.0.

6. A cellulose acetate band comprising the cellulose acetate fiber described in claim 1.

7. The cellulose acetate band according to claim 6, wherein a total denier is not less than 8000 and not greater than 44000.

8. The cellulose acetate fiber according to claim 1, wherein magnesium content is not smaller than 1 ppm.

9. The cellulose acetate fiber according to claim 1, wherein magnesium content is not smaller than 30 ppm.

10. The cellulose acetate fiber according to claim 1, wherein magnesium content is not smaller than 100 ppm.

11. The cellulose acetate fiber according to claim 1, wherein $Fe_2O_3$ is not smaller than 0.05 wt. % and not greater than 1 wt. %.

12. A method for producing a cellulose acetate band, the method comprising:

preparing a spinning dope including dissolving cellulose acetate, and adding at least one metal oxide selected from the group consisting of $Fe_3O_4$, $Fe_2O_3$, $MnO_2$, $Cr_2O_3$, $Cr_2CuO_4$, NiO, $Sb_2O_3$, and $CoAl_2O_4$ at not smaller than 0.05 wt. % and not greater than 1 wt. % in terms of solid content;

filtering the spinning dope; and spinning the cellulose acetate using the filtered spinning dope;

wherein titanium dioxide, if added, is not added until the spinning; and wherein the magnesium content is not greater than 300 ppm.

13. The method of claim 12, wherein titanium dioxide is not present in a spun fiber produced by the method.

14. The method of claim 12, where titanium dioxide is present in a spun fiber produced by the method in an amount of not greater than 0.05 wt. %.

* * * * *